United States Patent [19]

Alario et al.

[11] Patent Number: 4,470,451

[45] Date of Patent: Sep. 11, 1984

[54] DUAL AXIAL CHANNEL HEAT PIPE

[75] Inventors: Joseph P. Alario, Hauppauge; Robert A. Haslett, Dix Hills; Robert L. Kosson, Massapequa, all of N.Y.

[73] Assignee: Grumman Aerospace Corporation, Bethpage, N.Y.

[21] Appl. No.: 244,290

[22] Filed: Mar. 16, 1981

[51] Int. Cl.[3] ..... F28D 15/00

[52] U.S. Cl. ..... 165/104.26; 122/366

[58] Field of Search ..... 165/104.26; 122/366

[56] References Cited

U.S. PATENT DOCUMENTS

| | | | |
|---|---|---|---|
| 3,734,173 | 5/1973 | Moritz | 165/104.26 |
| 3,913,665 | 10/1975 | Franklin et al. | 165/104.26 |
| 3,971,634 | 7/1976 | Ranben et al. | 165/104.26 X |
| 4,351,388 | 9/1982 | Calhoun et al. | 165/104.26 |

FOREIGN PATENT DOCUMENTS 2255566 7/1975 France .

*Primary Examiner*—Albert W. Davis, Jr.
*Attorney, Agent, or Firm*—Richard G. Geib

[57] ABSTRACT

A heat pipe comprising an elongated sealed metallic envelope having at least a pair of longitudinal channels extending along the length thereof. One of the channels is for the circulation of the vapor phase of the working medium in operation and the other for the liquid phase and capillary means are provided to furnish fluid communication therebetween. Dedicated vapor and liquid channels result in low viscous pressure drops, the capillary communication means and circumferential grooving in the vapor channel provide high capillary pressure differences, and circumferential grooving is provided to furnish the high evaporation and condensation film coefficients required. To support higher heat fluxes, wicking can be used to augment the capillary flow from the liquid channel. To support higher evaporator heat flux without the need for wicking means, the heat pipe can be provided with more than one liquid channel, each communicating with the vapor channel by capillary means. The heat pipe can be provided with an integral fin or equivalent means for rejection of heat by radiation to ambient or for attachment to a source of heat in the evaporator region thereof.

15 Claims, 8 Drawing Figures

DUAL AXIAL CHANNEL HEAT PIPE

FIELD OF THE INVENTION

This invention relates to heat pipes and, more particularly, to a heat pipe having separate channels for the axial transport of the liquid and vapor phases of the working medium and capillary means providing fluid communication between the channels.

BACKGROUND OF THE INVENTION

In conventional heat pipes, particularly those designed for zero-g operation at temperatures below about 400° F., the thermal transport capacity of the device is controlled by the wick hydrodynamic limit in which the viscous flow pressure losses are equal to the maximum capillary induced pressure difference. A number of techniques have been proposed to eliminate or bypass this hydrodynamic limit; e.g.:

- Use of internal conventional or electromagnetic pumps which are electrically powered with the leads penetrating the heat pipe envelope.
- Electrostatic pumping using internal high voltage electrodes supplied from an external source of power and using a dielectric working fluid.
- Osmotic membranes.
- Extending current artery and/or grooved heat pipe technology to provide higher hydrodynamic pumping limits.

The use of a liquid pump, particularly in space radiator applications whose length may approach 60 feet (18 meters), is complicated by the length of the condenser which may extend the length of the space radiator. In such applications, there is no convenient sump. Also, electromagnetic pumping is difficult because the working fluids are dielectrics that must be relatively pure. Using additives in the working fluid to attain a pumping capability generally leads to a concentration buildup in the evaporator that adversely effects performance.

Electrostatic pumping has been the subject of some development work, generally with high voltage electrodes running the length of the heat pipe. The configuration is relatively complex by heat pipe standards and the reliability of the technique is unknown.

Osmotically pumped heat pipes were proposed quite early in heat pipe history but have only recently been subjected to active development. In osmotic pipes, condensate flows through a membrane into a solution which then flows to the evaporator. If the solution path is long and slender, however, mass diffusion within the solution will be negligible at even modest solution flow rates, the solute concentration on the solution side of the membrane becomes extremely low and the osmotic pressure will drop to a very low value. Thus, since long, slender solution flow paths are involved in heat pipes used as space radiators, an osmotic pipe would require some form, for example a liquid pump, of forced solution circulation with attendant disadvantageous complexities.

The approach taken in the subject invention is that of extending current capillary-pumped heat pipe technology to raise the hydrodynamic pumping limit. Either artery or groove approaches can be taken to increase heat pipe performance, but there are believed to be inherent advantages in the groove configuration.

Artery pipes present difficult scale-up problems for validation in 1-g conditions due to artery priming limits. Also, the artery configuration generally results in a greater vapor pressure drop for a given tube diameter and the sensitivity of arteries to gas bubble blockage has been well documented. Finally, the artery will always be a more difficult and costly large scale production process than a groove pipe which, after its forming die is designed and made, can be produced in quantity at low cost.

DESCRIPTION OF THE PRIOR ART

Both artery and grooved heat pipes are, of course, well known in the prior art. In the prior art, also, heat pipes that have dual axial channels are disclosed by G. M. Grover in U.S. Pat. Nos. 3,865,184 and 4,020,898; C. C. Roberts in U.S. Pat. No. 4,026,348; and W. R. Iriarte in U.S. Pat. No. 4,058,159. It will be seen, however, that the devices disclosed in these referenced patents are heat pipes designed for terrestrial use and gravity is relied upon to keep the working liquid almost substantially at the lowest level of the interior space of the heat pipe. Roberts, further, teaches a variable conductance heat pipe and what appears to be a dual fluid supply artery is functionally a fluid supply reservoir. The circulation of the working fluid in Roberts is controlled by vapor bubble injection means rather than the capillary forces of the present invention. In both Grover and Iriarte, liquid flows from the artery under gravity into a liquid pool which covers the bottom of the evaporator and partially submerges the wall grooves. In those designs, also, the liquid phase flow is open substantially to the interior of the vapor space of the heat pipe and an auxiliary tube or a divider plate is installed largely to prevent interference in the circulation of the vapor phase by wave action and the like of the liquid phase. Thus, the prior art discloses systems that have means for preventing an interaction between the liquid and vapor phase of the working fluid, but they do not provide a grooved heat pipe with a separate dedicated liquid channel which permits high heat transport capacity without impacting heat transfer efficiency. Most importantly, these prior art systems lack a continuous channel from condenser to evaporator for liquid flow induced solely by capillary forces, and hence would not work in the zero-g environment of space.

SUMMARY OF THE INVENTION

In conventional axial groove heat pipe technology, a relatively large number of grooves are utilized as a compromise between axial transport capacity (watt-meters) and efficient heat input and removal (watt/degrees C.). Heat transport capacity could be maximized by using fewer grooves of large diameter, since such a design minimizes the liquid viscous pressure losses; however, using only a few grooves results in poorer heat transfer coefficients. Although adversely affecting transport capacity, a larger number of grooves are needed to provide good evaporation and condensation heat transfer film coefficients. In existing prior art designs, evaporation takes place mainly at the meniscus contact line and hence is directly proportional to the number of grooves. Since condensation liquid layer thickness is related to the spacing between grooves, it also depends on the number of grooves. Therefore, using more grooves, conventional axial groove heat pipe designs improve heat transfer film coefficients, but at the expense of lowering the heat transfer capacity.

In the subject invention, two relatively large axial channels, a larger one for vapor and a smaller one for liquid, are provided, permitting the axial transport and radial heat transfer requirements to be handled independently. Capillary means are provided for the passage of fluid between the channels. In one embodiment the walls of the vapor channel are incised with circumferential grooves and the capillary means is a narrow longitudinal slot which is provided between the vapor channel and the liquid channel which has plain walls. The narrow slot joining the two channels creates a high capillary pressure difference which, coupled with the minimized flow resistance of the two separate channels, result in a high axial heat transport capacity. High evaporation and condensation film coefficients are obtained independently by the circumferential grooves in the vapor channel without interfering with the overall heat transport capability of the axial liquid channel.

In a further heat pipe embodiment, the inside walls of a tubular envelope are provided with circumferential capillary grooves and a baffle plate fitting tightly against the side and end walls divides the envelope into a larger vapor channel and a smaller liquid channel. Fluid communication between the channels is by means of the circumferential capillary grooves.

A continuous liquid flow path between the primary axial channel and the circumferential wall grooves in the evaporator section of the vapor channel must be maintained in the heat pipe of this invention. This continuity must be assured with the groove and longitudinal slot menisci realistically depressed to reflect maximum heat flux conditions. In low heat flux designs, the liquid viscous flow losses in the circumferential grooves will be small, permitting all flow to be by wick communication between the wall grooves as machined and the slot of the liquid channel. However, to support higher heat fluxes, an augmented wall wick is used to assist the liquid flow from the longitudinal liquid channel to the more distant regions of the circumferential grooves.

To permit higher evaporator heat flux levels without the need for wick augmentation, further embodiments of the heat pipe of the invention are provided with multiple liquid channels which are connected to the vapor channel by capillary means.

It is a principal object of the invention to provide a heat pipe having separate channels for the liquid and the vapor flow, capillary means being provided to furnish fluid communication in operation between the channels.

It is a further object of the invention to provide means in a heat pipe to insure high performance without compromise between axial transport capacity and radial heat transfer efficiency.

Another object of the invention is to provide a grooved heat pipe having high performance in a zero-g environment with capillary forces entirely controlling the working liquid of the heat pipe in operation.

Yet another object of the invention is to provide a high performance heat pipe requiring no moving parts or auxiliary equipment to attain its performance capabilities, and which heat pipe is designed for ease and economy of manufacture.

DESCRIPTION OF THE DRAWINGS

For the purpose of illustrating the invention, there is shown in the drawings the forms which are presently preferred; however, it should be understood that the invention is not necessarily limited to the precise arrangements here shown.

DESCRIPTION OF THE PREFERRED EMBODIMENTS

Figure 1:
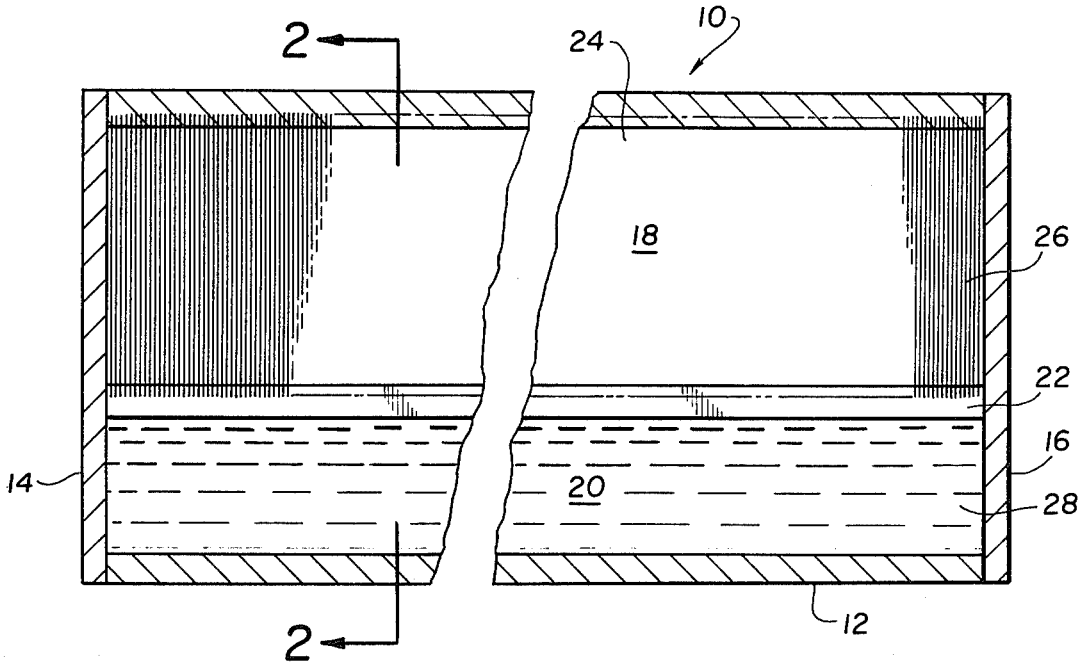
FIG. 1 is a longitudinal cross-sectional view of a preferred embodiment of the heat pipe of the invention.
Figure 2:
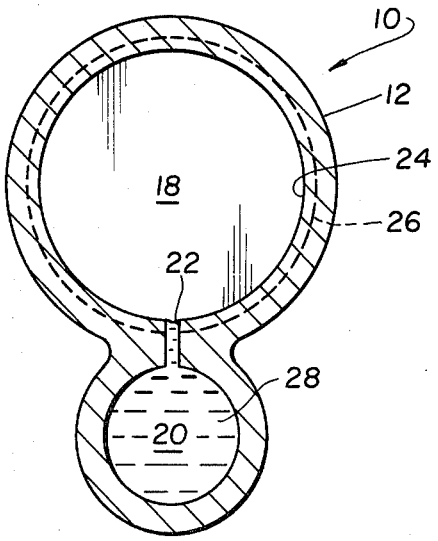
FIG. 2 is a transverse cross-sectional view of the heat pipe of FIG. 1 taken along line 2—2.

Having now more particularly reference to the drawings, FIGS. 1 and 2 show a preferred embodiment of the heat pipe 10 of the invention. As is the usual practice, heat pipe 10 comprises an elongated envelope 12 having end walls 14 and 16 at either end thereof. The envelope and end walls preferably are fabricated out of aluminum, but any other suitable material such as copper and the like having the required thermal conductivity and resistance to corrosion in the environment of use can be employed. Heat pipe 10 has a tubular longitudinal vapor channel 18 and a tubular longitudinal liquid channel 20 extending the length thereof with the axes of the channels parallel one to the other. Joining the channels such that they are in fluid communication along their length is a capillary slot 22. It should be noted that slot 22 is essential in the evaporator and condenser sections of the heat pipe of this invention to the functioning of the design. However, in applications of the design in which the evaporator section of the heat pipe is located remotely from the condenser section thereof, the transport section between the evaporator and condenser sections can be fabricated out of plainwall tubing; i.e., without capillary slot 22. Slot 22 is made as narrow as possible to maximize the capillary pressure differential $\Delta P$. The interior peripheral wall 24 of the vapor channel 18 is provided with closely spaced, generally circumferentially extending capillary grooves 26 throughout substantially its entire length. Capillary grooves 26 may be incised as a continuous helical groove to facilitate manufacture, or a series of separate annular grooves can be provided. Typically, 160 to 200 grooves per inch are provided. The capillary grooves 26 are not necessary in the transport section of the heat pipe, however, and can be provided or not, depending on manufacturing convenience. As previously stated, the ends of the elongated envelope 12 are hermetically sealed by end walls 14, 16. In the fabrication of the heat pipe, the envelope is first evacuated by means of a suitable fitting (not shown) in either of the end walls. Thereafter, a suitable quantity of a liquid phase/vapor phase working fluid 28 is admitted through the fitting which is then permanently sealed as by crimping followed by a soldering or welding operation in accordance with standard industry practice.

The environment of use will determine the working fluid 28 to be employed. In applications of the heat pipe to space radiators, acetone is the preferred working fluid at temperature levels ranging between 40–250 degrees F. and ammonia at temperature levels ranging between 0–150 degrees F. When acetone is the working fluid, the diameter of the vapor channel 18 will be about 0.75 in, the diameter of the liquid channel 20 about 0.40 in, the capillary slot 22 will be about 0.008 in wide, capillary grooves 26 about 0.008 in deep, and the wall thickness of the heat pipe envelope 12 about 0.040 in. When ammonia is the working fluid, the vapor channel 18 will have a diameter of about 0.33 in, the liquid channel 20 a diameter of 0.25 in, and the dimensions of the capillary grooves and slot and the wall thickness will be the same as that of the heat pipe using acetone. Using heat pipes having the foregoing dimensions, the acetone design is calculated to have a heat transport capability at 250 degrees F. of 792,000 watt-in and the ammonia design is calculated to have a capability at 150 degrees F. of 407,000 watt-in.

In operation, when one portion of the envelope 12 of the heat pipe is exposed to a relatively higher temperature, it functions as an evaporator section. The circumferential wall grooves 26 in the evaporator section of the heat pipe are filled with liquid pumped there from the liquid channel 20 by capillary action. When exposed to a relatively higher temperature, evaporation occurs at the meniscus contact line of the grooves. This vaporized working fluid flows in the vapor phase along vapor channel 18 to the relatively lower temperature section of the heat pipe which becomes the condenser section. There, the working fluid is condensed and the liquid phase flows along the liquid channel 20 and is returned to the evaporator section. In the evaporator section, the fluid again flows into the wall grooves by capillary action such that evaporation occurs and the cycle is repeated.

Figure 3:
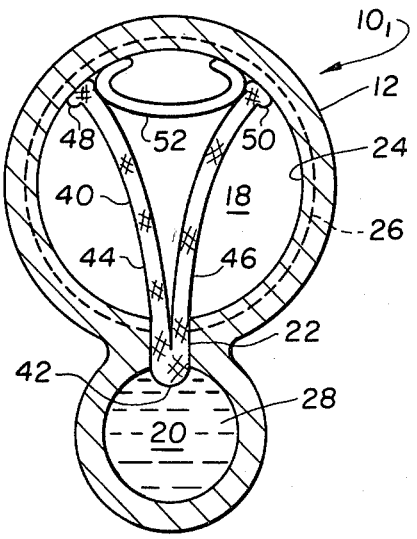
FIG. 3 is a transverse cross-sectional view of another embodiment of the heat pipe of the invention.

To support higher heat fluxes, the wicking capabilities of the heat pipe can be augmented. Such augmentation is utilized in the embodiments of the heat pipe shown in FIGS. 3, 4 and 5. The embodiment shown in FIG. 3 comprises a heat pipe $10_1$ substantially identical to heat pipe 10 of FIGS. 1 and 2 except for a porous wick 40 whose lower end 42 is inserted in the capillary slot 22 in the evaporator portion of the heat pipe $10_1$. Wick 40 is fabricated out of any suitable porous wicking material and has a V-shaped configuration in cross section with the lower end or apex 42 and two branching arms 44 and 46 which terminate in enlarged upper end portions 48 and 50 respectively. Lower end 42 of the wick dips into the working fluid 28 in the liquid channel 20 and the arms extend across vapor channel 18 such that the enlarged upper end portions 48 and 50 contact the circumferential grooves 26 at points remote from capillary slot 22. The wick thus provides auxiliary liquid flow paths to support the increased evaporation rate associated with higher wall heat flux levels. Spring clip retainers 52 are provided to retain the wick 40 in position against the inside walls 24 (and grooves 26) of the vapor channel 18.

Figure 4:
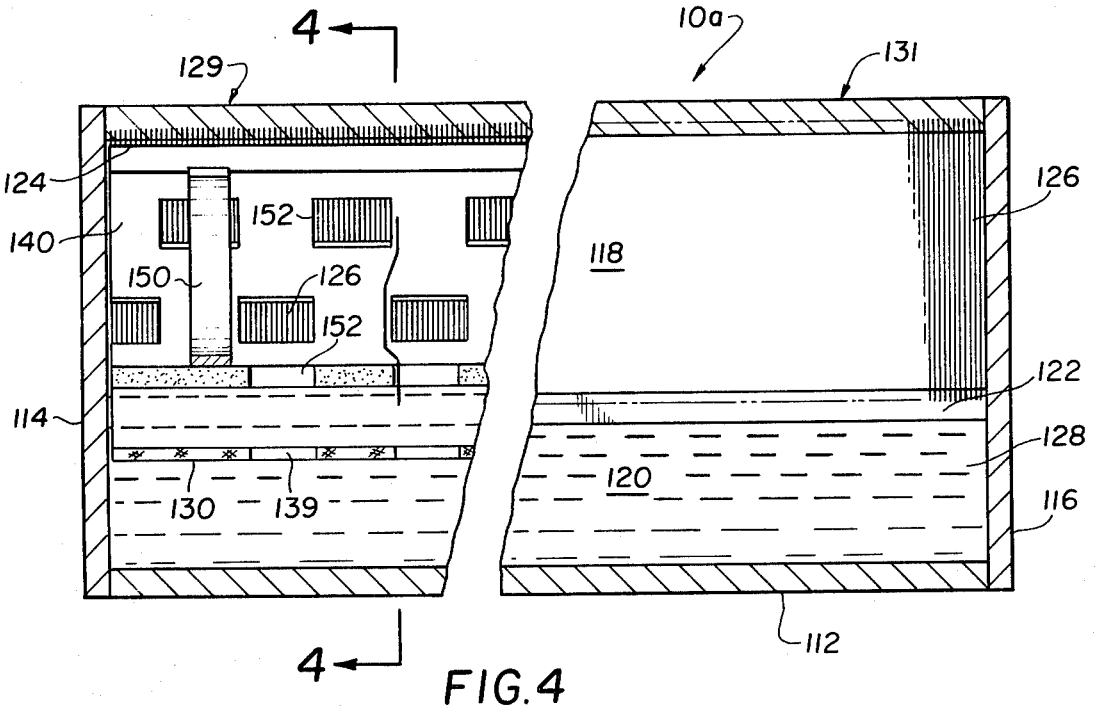
FIG. 4 is a longitudinal cross-sectional view of a further preferred embodiment of the heat pipe of the invention.
Figure 5:
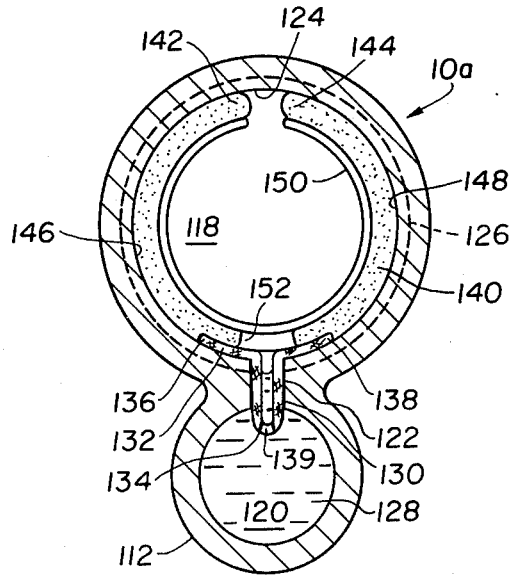
FIG. 5 is a transverse cross-sectional view of the heat pipe of FIG. 4 taken along line 4—4.

An alternate method of augmenting the flow of liquid circumferentially to the walls of the evaporator portion of the heat pipe is illustrated in FIGS. 4 and 5. As in the FIGS. 1 and 2 embodiment of the invention, heat pipe **10*a* of FIGS. 4 and 5 comprises an elongated envelope 112 having at either end thereof, end walls 114 and 116. Extending the length of the envelope 112 with the axes thereof parallel to one another are a tubular longitudinal vapor channel 118 and a tubular longitudinal liquid channel 120. Joining the channels such that they are in fluid communication along their lenght is a capillary slot 122. Slot 122 is made as narrow as is possible to maxmimize the capillary pressure differential $\Delta P$. Interior peripheral wall 124 of the vapor channel 118 is provided with closely spaced helical or circumferentially parallel capillary grooves 126** extending along substantially the entire evaporator and condenser lengths of the channel.

It will be appreciated that heat pipe **10*a* as described to this point is essentially similar to heat pipe 10 embodied in FIGS. 1 and 2: the same design principles and details, materials and methods of construction can be used, and the same working fluids and methods of filling the heat pipe therewith can be utilized. However, in heat pipe 10*a*, the wicking system is augmented in the evaporator section 129 thereof by an insert 130 of a suitable screening or porous material which is positioned in capillary slot 122 such that it dips into the working fluid 128 in the liquid channel 120. Insert 130 is fabricated out of an elongated strip 132 of wicking material which is substantially as long as slot 122 in the evaporator section 129 of the heat pipe. Strip 132 is folded longitudinally and the fold or bight portion 134 thereof is partitioned in slot 122 and the longitudinal edges 136 and 138 are laid against wall 124 in working contact with capillary grooves 126. A random pattern of vent openings 139 are provided in insert 130 to vent the liquid channel 120 to prevent an accumulation of vapor therein. Associated with insert 130 in heat pipe 10*a* is a semi-cylindrical wick 140 of a suitable porous material. Wick 140 is substantially the same length as insert 130 and the longitudinal edges 142 and 144 thereof extend to the upper portions of the inside of the side walls 146 and 148 of the vapor channel. Wick 140 overlies the longitudinal edges 136 and 138 of the insert 130 and is held in close physical contact therewith and with the inside walls of the vapor channel by spring clip retainers 150. If required, the retainers 150 can be bonded to wick 140. In this design, the effective pore size of the porous material of wick 140 is selected to be smaller than the width of the capillary grooves 126. A pattern of vent openings 152 also is provided in wick 140 to vent the capillary grooves 126** such that each of said grooves has at least one vent opening.

In the operation of heat pipe 10 of FIGS. 1 and 2, the circumferential capillary grooves 26 in the evaporator section of the heat pipe are filled by means of slot 22 with liquid from channel 20 and evaporation occurs at the meniscus contact line. In the operation of heat pipe **10*a* of FIGS. 4 and 5, evaporation in the evaporator section 129 also takes place along a meniscus contact line within the capillary grooves 126, but with one important exception; in heat pipe 10*a*, the grooves 126 in the evaporator section are filled with a vapor with the wick 140 acting to supply liquid thereto. Wick 140 is fed by a capillary flow of liquid 128 from liquid channel 120 through insert 130 in slot 122. Because the effective pore size of the wick 140 is smaller than that of the capillary grooves 126, the wick becomes saturated with liquid which is fed to the grooves 126 for evaporation at the meniscus contact line thereof. Vapor flows circumferentially along the capillary grooves and then passes through the vent openings 152 into the vapor channel 118 for circulation to the condenser section 131 of the heat pipe. As in heat pipe 10, the liquid phase of the working fluid returns to the evaporator section by means of liquid channel 120**.

Although the design of the heat pipe of our invention was optimized for high performance, large scale zero-g space applications such as in radiator systems, an advantage of the design is that it can be tested on earth. During 1-g testing on earth, the liquid channel of the heat pipe must be oriented downward in the 6 o'clock position. Otherwise the circumferential wall grooves would act as syphons, draining liquid from the liquid channel. Because of high vapor velocities, any free liquid accumulating as a puddle would be entrained by the vapor and carried to the condenser section reducing the efficiency of the heat pipe. In this design, the capillary slot between the vapor and liquid channels is of a sufficiently small size to prevent any entrainment of liquid from the liquid channel itself. It will be appreciated that in 1-g tests on earth, gravity will assist the circumferential flow of liquid into the liquid channel in the condenser and will resist the circumferential flow in the evaporator section.

Figure 6:
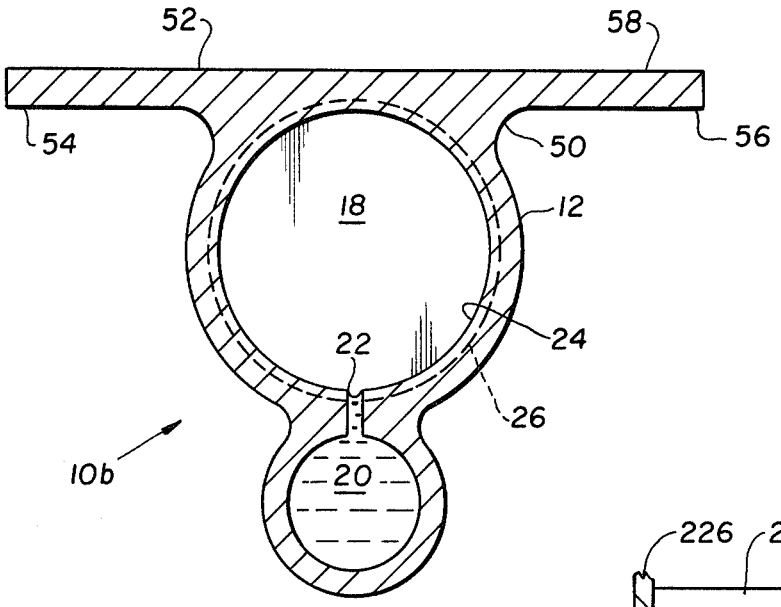
FIGS. 6–8 are transverse cross-sectional views of yet further embodiments of the heat pipe of the invention.

A further embodiment of the heat pipe of the invention is illustrated in FIG. 6. Heat pipe **10*b* of FIG. 6 is substantially identical in construction and operation to heat pipe 10 of FIGS. 1 and 2 except for an integral heat exchange fin. Heat pipe 10*b* thus has an enlongated envelope 12, a longitudinal vapor channel 18, a longitudinal liquid channel 20, and a capillary slot 22 therebetween. Capillary grooves 26 are provided in the wall 24 of the vapor channel. Integral with the upper wall portion 50 of envelope 12 is an integral fin 52 extending longitudinally the length of the envelope. Fin 52 has horizontally extending side wings 54 and 56 and an upper surface 58** which can be flat as shown or can be suitably shaped to meet the requirements of use. In operation, the fin serves as a radiator surface for the condenser section of the heat pipe and as a mating surface to a heat source for the evaporator section.

Figure 7:
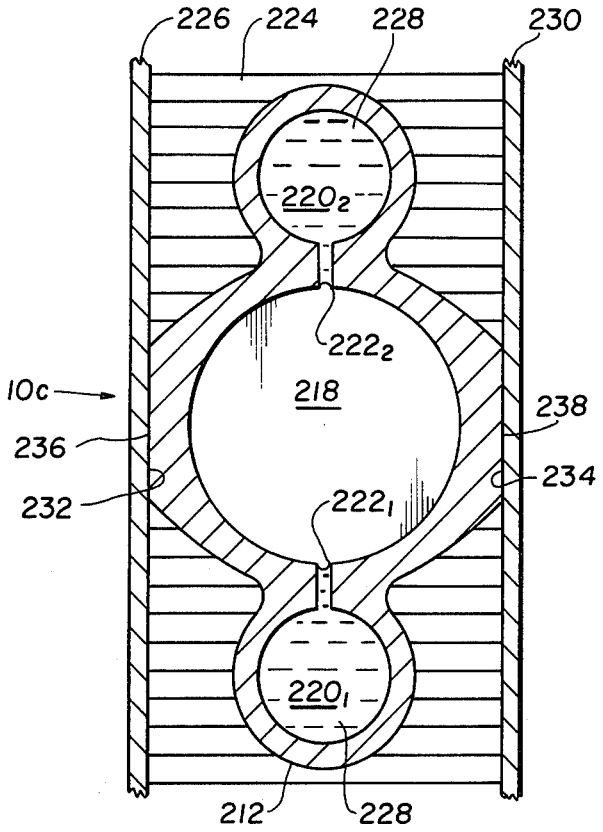

To permit higher evaporator heat flux levels, the heat pipe of the invention can be provided with more than one liquid channel. A heat pipe **10*c* having two liquid channels is illustrated in FIG. 7. With the exception of the multiple fluid channels, the construction and operation of heat pipe 10*c* are substantially identical to heat pipe 10 of FIGS. 1 and 2. Heat pipe 10*c* thus has an elongated envelope 212, vapor channel 218, liquid channels $\mathbf{220}_1$ and $\mathbf{220}_2$ with capillary slots $\mathbf{222}_1$ and $\mathbf{222}_2$ respectively communicating with the vapor channel. As indicated in FIG. 7, showing heat pipe 10*c* in a zero-g space environment, both liquid channels in operation are filled with the liquid phase 228 of the volatile working fluid. The design of the FIG. 7 embodiment permits higher evaporator heat flux levels without the need for wick augmentation. To improve the thermal efficiency of the heat pipe in use, envelope 212 is embedded in honeycomb core material 224 having face sheets 226 and 230 bonded thereon. The inside surfaces 232 and 234 of the face sheets are in good thermal contact with the outside surfaces 236 and 238 of the heat pipe envelope 212. Surfaces 236 and 238 can be shaped as required to increase the thermal contact area. Face sheets 226 and 230** serve either for the rejection of heat by radiation to ambient or for attachment to a source of heat (not shown) in the evaporator section of the heat pipe. It will be noted that the multiple liquid channel heat pipes are not completely ground testable since the liquid in the upwardly oriented channel will tend to drain due to gravity.

Figure 8:
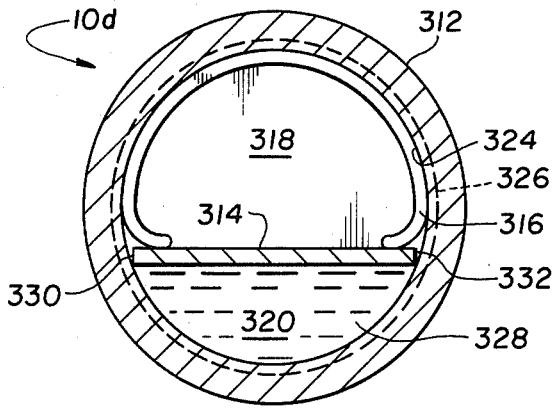

In a further embodiment **10*d* of the heat pipe of the invention, a longitudinal plate is used to divide a conventional tubular heat pipe into a vapor channel and a liquid channel. As illustrated in FIG. 8, heat pipe 10*d* comprises an elongated tubular envelope 312 whose ends are hermetically sealed by end walls (not shown). The interior peripheral wall 324 of the envelope is provided with closely spaced, generally circumferentially extending capillary grooves 326 throughout substantially the length of the envelope. The interior volume of the envelope is divided by a baffle plate 314 which extends the full length of the envelope and which has its ends seated tightly against the envelope end walls. Spring clip retainers 316 suitably spaced along the length of the envelope hold the edges 330 and 332 of plate 314 firmly against the envelope wall 324. The width of the baffle plate is smaller than the inside diameter of the envelope such that the envelope is divided into two unequal passages or channels. The smaller channel 320 will fill with the liquid working medium 328 and the larger channel 318** will fill with vapor.

In operation, the circumerential wall grooves 326 in the evaporator section of the heat pipe are filled with liquid pumped there from the liquid channel 320 by capillary action. Evaporation in the evaporator section of the vapor channel occurs at the meniscus contact line of grooves 326. This vaporized fluid flows in the vapor phase along vapor channel 318 to the condenser section of the heat pipe. There, the working fluid is condensed and the liquid phase flows along liquid channel 320 and is returned to the evaporator section. In this embodiment, fluid flow between the liquid channel 320 and the vapor channel 318 occurs only through the capillary grooves 326.

Heat pipe **10*d* is provided with a single baffle plate 314 that divides it into two channels 318 and 320. It will be appreciated that locating a second baffle plate in the upper portion of the interior volume of the heat pipe envelope forms a configuration having a central vapor channel and an upper and lower liquid channel equivalent to the construction shown in FIG. 7. As is the case with heat pipe 10*c* of FIG. 7**, the multiple liquid channel configuration is not completely ground testable.

Although shown and described in what are believed to be the most practical and preferred embodiments, it is apparent that departures from the specific methods and designs described will suggest themselves to those skilled in the art and may be made without departing from the spirit and scope of the invention. We therefore, do not wish to restrict ourselves to the particular constructions illustrated and described, but desire to avail ourselves of all modifications that may fall within the scope of the appended claims.

Having thus described our invention, what we claim is:

1. In a heat pipe, the improvement comprising:

a generally straight elongated thermally conductive envelope hermetically sealed with end walls and having a relatively low-temperature condensing section and a relatively high-temperature evaporation section between which thermal energy is transferred, said envelope having a longitudinal vapor channel and at least one longitudinal liquid channel extending the length thereof, said channels being separate one from the other and having a side-by-side relationship with their longitudinal axes being substantially parallel, capillary means extending the length of said envelope at least in the evaporation and condensing sections thereof providing fluid communication between said channels, the inside surface of the side walls of at least said vapor channel in at least said condensing and evaporation sections being provided with wall capillary means, said capillary means being a longitudinal capillary slot which creates a high capillary pressure difference such that liquid in said longitudinal liquid channel is pumped thereby;

a vaporizable working fluid in said envelope, said fluid having a liquid phase and a vapor phase at the operating temperature of the device, said fluid evaporating in said high temperature evaporation section and condensing in said low temperature condensing section such that heat is transferred between said evaporation section and said condensing section by phase change of said fluid, said liquid phase substantially filling said liquid channel at said operating temperature and flowing from said condensing section to said evaporation section and said vapor phase flowing along said vapor channel from said evaporation section to said condensing section whereby the axial transport and radial heat transfer requirements of said heat pipe are handled independently such that a high heat transport capacity is obtainable without a degradation in heat transfer efficiency.

2. The heat pipe defined in claim 1 wherein at least the vapor channel in at least the condensing and evaporation sections thereof are provided with wall capillary means and wherein the capillary means providing fluid communication between the channels is a capillary slot feeding said wall capillary means.

3. The heat pipe defined in claim 1 wherein the vapor channel is larger than the liquid channel.

4. The heat pipe defined in claim 2 wherein the vapor channel wall capillary means are capillary grooves incised circumferentially in said walls.

5. The heat pipe defined in claim 2 wherein the envelope has a longitudinal vapor channel and longitudinal liquid channels disposed on either side thereof, capillary slots joining said liquid channels with said vapor channel for fluid communication therebetween.

6. The heat pipe defined in claim 5 wherein one liquid channel is disposed above the vapor channel and the other below it.

7. The heat pipe defined in claim 2 wherein wicking means are provided between the capillary slot and points along the circumference of the vapor channel to provide auxiliary liquid flow paths from said slot to said wall capillary means.

8. The heat pipe defined in claim 7 wherein the wicking means extend longitudinally along the vapor channel and wherein said wicking means is V-shaped in cross-section with the apex of the "V" inserted in the capillary slot and the ends of the arms of the "V" contacting the wall capillary means.

9. The heat pipe defined in claim 8 wherein spring clip means between the arms of the "V" bias them into contact with the wall capillary means to thereby retain the wicking means in place.

10. The heat pipe defined in claim 2 wherein a strip of wicking material is inserted in the capillary slot in the evaporator section, said strip being folded longitudinally with the bight of said folded strip extending through said slot and into the liquid channel, the longitudinal edge portions of said strip being disposed on either side of said slot in the vapor channel along the walls thereof and in fluid contact with the capillary means therein, a semi-cylindrical wall wick positioned along the length of said evaporator section in said vapor channel with the longitudinal side edges of said wick extending circumferentially on the side walls of said vapor channel in fluid contact with the capillary means in said walls, said wall wick overlying the longitudinal edge portions of said strip in fluid contact therewith such that liquid is fed from said liquid channel through said strip and wall wick to said capillary means whereby the transport of liquid from said liquid channels to said vapor channel is augmented thereby, said wall wick and said strip having vent slots therethrough for the venting of vapor, and spring clip means in the bore of said vapor channel for biasing said wall wick outwardly into intimate contact with the walls of said vapor channel and said edge portions of said strip.

11. The heat pipe defined in claim 2 wherein the liquid surface of the concave meniscus formed in the liquid from the liquid chanel in the capillary slot extends to the capillary means in the walls of the vapor channel.

12. The heat pipe defined in claim 10 wherein the effective pore size of the wall wick is smaller than the width of the wall capillary means of the vapor channel whereby evaporation occurs substantially from the meniscus contact line in said wall capillary means, and the vapor formed by said evaporation preferentially fills and flows through said wall capillary means.

13. The heat pipe defined in claim 1 wherein said heat pipe has heat transfer means associated with the outside surface of the heat pipe envelope adjoining the vapor channel therein.

14. The heat pipe defined in claim 13 wherein said heat transfer means is a longitudinal integral fin extending the length of the heat pipe envelope, said fin having relatively thin wing portions on either side extending transversely therefrom.

15. The heat pipe defined in claim 13 wherein the heat transfer means is a honeycomb core sandwich structure enclosing the length of the heat pipe envelope and extending the length thereof, the core of said structure being formed such that the inside surface of the face sheets of said structure is in good thermal contact with the outside surface of the vapor channel of said heat pipe.

* * * * *

UNITED STATES PATENT AND TRADEMARK OFFICE

CERTIFICATE OF CORRECTION

PATENT NO. : 4,470,451
DATED : September 11, 1984
INVENTOR(S) : Joseph P. Alario et al It is certified that error appears in the above-identified patent and that said Letters Patent are hereby corrected as shown below:

Col 1, before line 5, insert

-- The invention described herein was made in the performance of work under NASA Contract NAS 9-15965 and is subject to the provisions of Section 305 of the National Aeronautics and Space Act of 1958 (72 Stat. 435; 42 U.S.C. 2457). --

Signed and Sealed this

*Twenty-second* Day of *October 1985*

[SEAL]

*Attest:*

*Attesting Officer*

DONALD J. QUIGG

*Commissioner of Patents and Trademarks—Designate*